United States Patent [19]

Murakami

[11] 4,120,147

[45] Oct. 17, 1978

[54] WATCH MODULE ASSEMBLY

[75] Inventor: Tomomi Murakami, Higashiyamoto, Japan

[73] Assignee: Citizen Watch Company Limited, Tokyo, Japan

[21] Appl. No.: 756,561

[22] Filed: Jan. 3, 1977

[30] Foreign Application Priority Data

Jan. 8, 1976 [JP] Japan ..... 51-1765
Mar. 2, 1976 [JP] Japan ..... 51-22407

[51] Int. Cl.[2] ..... G04B 37/04; G04C 3/00; G04C 17/00

[52] U.S. Cl. ..... 58/50 R; 58/23 R; 58/23 BA; 58/88 R

[58] Field of Search ..... 58/23 R, 23 AC, 23 BA, 58/50 R, 88 R

[56] References Cited

U.S. PATENT DOCUMENTS

| | | | |
|---|---|---|---|
| 3,863,436 | 2/1975 | Schwarzschild et al. | 58/50 R |
| 3,883,213 | 5/1975 | Glaister | 58/50 R X |
| 3,905,666 | 9/1975 | Grimm et al. | 58/23 R X |
| 3,945,196 | 3/1976 | Wood et al. | 58/50 R |
| 3,986,334 | 10/1976 | Harper | 58/50 R |
| 3,986,335 | 10/1976 | Harper | 58/50 R |
| 4,042,861 | 8/1977 | Yasuda | 58/23 R |
| 4,045,953 | 9/1977 | Miyazaki | 58/23 R |
| 4,068,464 | 1/1978 | Barnett, et al. | 58/50 R |
| 4,075,825 | 2/1978 | Murakami et al. | 58/23 R |

FOREIGN PATENT DOCUMENTS

| | | | |
|---|---|---|---|
| 2,532,421 | 2/1976 | Fed. Rep. of Germany | 58/50 R |
| 2,254,055 | 7/1975 | France | 58/50 R |

*Primary Examiner*—Stanley J. Witkowski
*Attorney, Agent, or Firm*—Frank J. Jordan

[57] ABSTRACT

A watch module which comprises an electrooptical display device having ledges formed with rows of electrical contact terminals parallel to and spaced from each other by a predetermined distance greater than a diameter of a battery, a substrate including an integrated circuit chip mounted on one side thereof at a position displaced from the center of the watch module and printed circuit leads formed on the one side of the substrate and connected between the integrated circuit chip and second rows of electrical contact terminals precisely aligned with the first rows of electrical contact terminals on the display device, the substrate having a cutout to provide a space for accommodating the battery in a substantially straight line with the integrated circuit chip on the substantially same plane at the back side of the display device, a support frame fixedly supporting the display device, a battery support plate carried on the support frame and interposed between the battery and the display device, and a compressible conducting member disposed between the display device and the substrate to provide electrical connections between the electrical contact terminals on the display device and the electrical contact terminals on the substrate.

9 Claims, 6 Drawing Figures

WATCH MODULE ASSEMBLY

This invention relates to electronic timepieces equipped with electrooptical display devices and, more particularly, to a module assembly specifically suited for such electronic timepieces.

Large numbers of electronic timepieces employing liquid crystal display systems have been developed and the electronic elements used in their construction have in recent years become quite small in size. Of those components, the battery, the large scale integrated circuit (LSI) and the liquid crystal display cell occupy a rather large amount of space. In conventional electronic timepieces these three components have been arranged by stacking them one above the other or by aligning the liquid crystal display element and battery in the same plane. Both of these arrangements have their own particular merits but their demerits are also large in number. For example, it can be pointed out that although the planar arrangement allows for a slim timepiece the size of the battery reduces the area available for the display which is the very component responsible for indicating the time. Stacking the components does not offer a suitable alternative since this greatly increases the thickness of the timepiece.

It is, therefore, an object of the present invention to provide an improved watch module assembly which is slim in construction but which offers a larged-sized display in a limited amount of space.

It is another object of the present invention to provide a watch module assembly which may be assembled in a watch case and removed and disassembled with ease to replace any individual components.

It is another object of the present invention to provide a watch module assembly which is shock-resistant.

It is still another object of the present invention to provide a watch module assembly which permits the use of minimum number of components which are disposed in a specific arrangement to reduce the thickness of the module.

These and other objects, features and advantages of the present invention will become more apparent from the following description when taken in conjunction with the accompanying drawings, in which.

Figure 1:
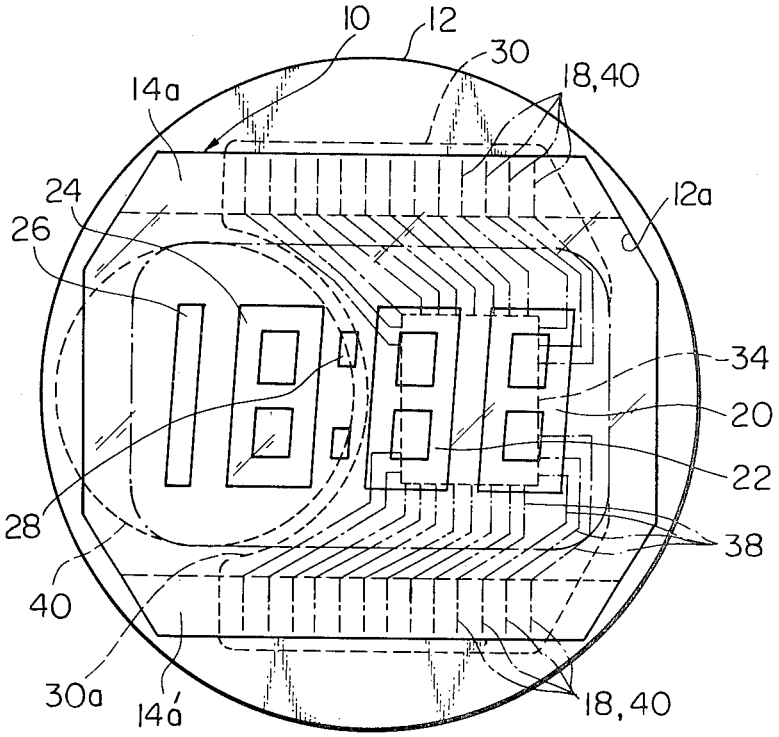
FIG. 1 is a plan view of a preferred embodiment of a watch module construction according to the present invention.
Figure 2:
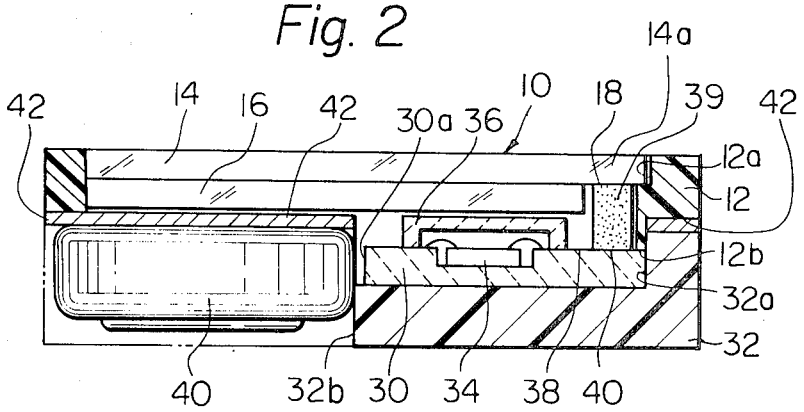
FIG. 2 is a cross sectional view of the module construction shown in FIG. 1.

Referring now to FIGS. 1 and 2, there is shown a first preferred embodiment of a solid state watch module construction embodying the present invention. As shown, the watch module construction includes an electrooptical display device 10, which is fixedly held in place by a support frame 12 preferably made of an insulating material such as plastics or synthetic resin.

The electrooptical display device 10 may be of any known types proposed in the prior art such as liquid crystal, electrophoretic, light emitting diode, electrochromic etc. having the common characteristic that time indicating characters are made visible on the viewing surface by applying suitably coded drive signals to the display device. The type of display device shown in the preferred embodiment is a liquid crystal display cell and comprises a sandwich construction of a first glass layer 14 and a second glass layer 16 sealed thereto. A chamber between the first and second layers 14 and 16 contains liquid crystal material (not shown) suitable for display of time information.

The glass layer 14 of the display cell 10 has ledges **14*a* and 14'*a* providing first and second rows of electrical contact terminals 18 parallel to and spaced from each other on its underside. The display cell 10 is located in the support frame 12 by means of a recess 12*a* with a shoulder on which the first glass layer 14** rests.

The display cell shown in FIG. 1 includes a 7-segment digits 20, 22, 24, a single segment digit 26 and "colon" segments 28. The 7-segment digits, such as 20, are made up of individually energizable segments. Each segment is connected by a lead (not shown) to a respective electrical contact terminal 18.

Referring to FIG. 2, a printed circuit substrate 30 made of insulating material such as ceramic is disposed in a recess **32*a* of a second support frame 32 which is made of the same material as the first frame 12 and its axial movement is prevented by a bottom wall 12*b* of the first support frame 12 engaging the upper surface of the substrate 30. The upper surface of the substrate 30 provides the mounting area for an integrated circuit chip 34 which is encapsulated by a ceramic cap 36, which is fastened to the upper surface of the substrate by some suitable means to protect the integrated circuit chip 34. The integrated circuit chip 34 is arranged to provide suitably coded drive signals and wire-bonded to printed circuit leads 38 substantially symmetrically formed on the upper surface or the display side of the substrate 30 as shown in FIG. 1, in which the integrated circuit chip 34 is seen to be located on the substrate at a position displaced from the center of the frame 12 for a reason as will be described in later. The printed circuit leads 38 are electrically connected to contact terminals 41 which are similar to the contact terminals 18 and provided on the upper surface of the substrate 30. The terminals 41 are precisely aligned with the terminals 18 on the display cell 10. Compressible conductive rubber members 39 are disposed between the first glass layer 14 and the substrate 30 to provide an electrical connection between the terminals 18 and 40**.

As shown in FIG. 1, the substrate 30 has a rounded cutout **30*a* to provide a mounting space for a battery 40, which is consequently arranged in the substantially same plane as the integrated circuit chip 34 at the back side of the display cell 10. The second support frame 32 has a cutout 32*b* partially conforming to the shape of the battery 40 to permit easy replacement of the battery. A battery support plate 42 preprably made of a metal is disposed between the display cell 10 and the battery 40 and fixed in place by first and second support frames 12 and 32 to prevent the battery 40 from contacting the display cell 10** when the module is subjected to impack shocks.

According to the preferred embodiment shown in FIGS. 1 and 2, since a pair of rows of electrical contact terminals 18, are formed parallel to and spaced from each other on the underside of the ledges 14*a* of the first glass layer 14 and the printed circuit leads 38 are substantially symmetrically arranged with respect to the longitudinal axis of the substrate 30, the battery 40 and the integrated circuit chip 34 are arranged in a straight line and interposed between the two rows of the electrical contact terminals at the back side of the display cell 10. Such an arrangement can be readily wired and does not require that the battery 40 and the ceramic substrate 30 be stacked one upon the other. This is extremely advantageous for a digital electronic timepiece since it maximizes the amount of space available for a digital display.

Figure 3:
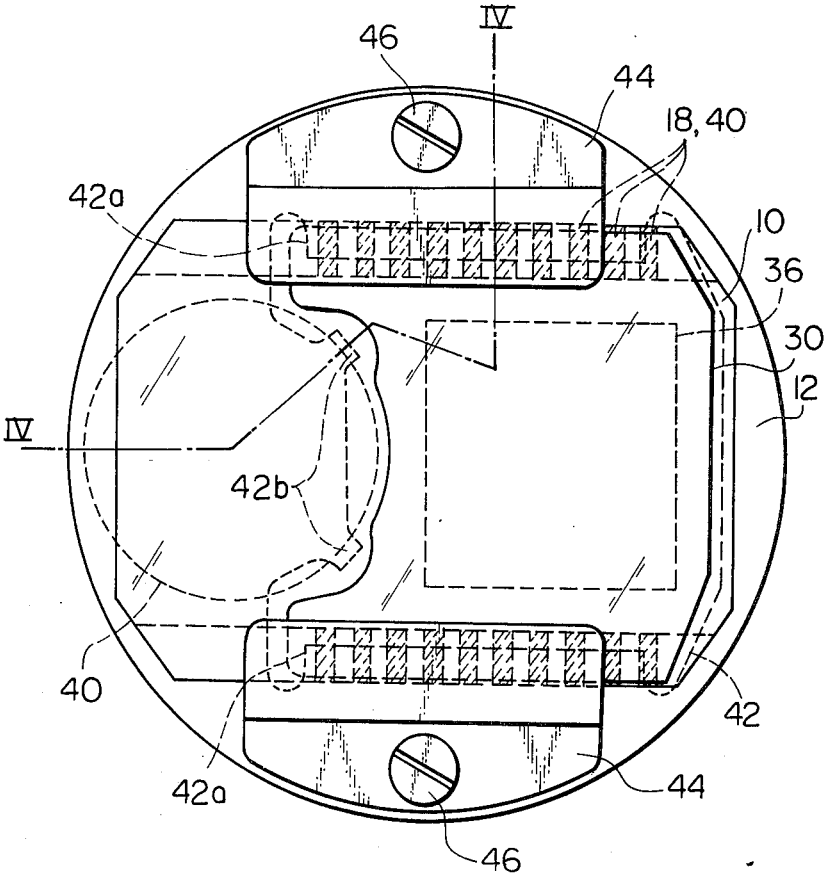
FIG. 3 is a plan view of another preferred embodiment of the watch module construction according to the present invention.
Figure 4:
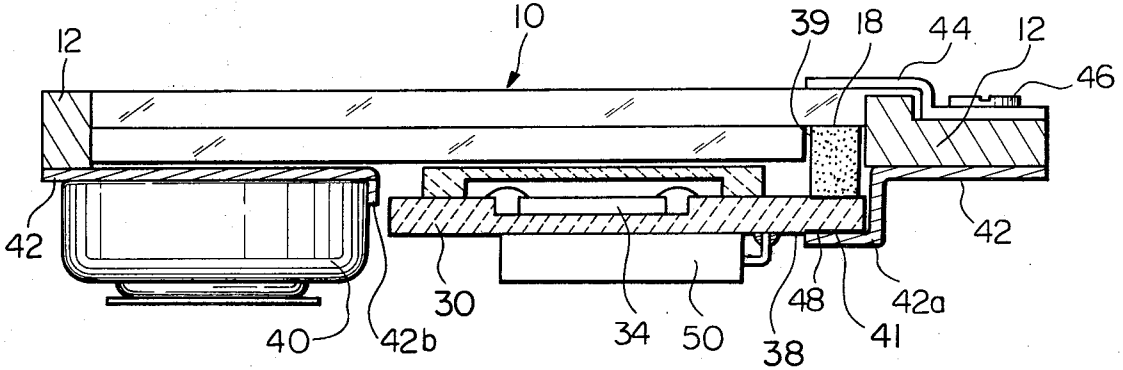
FIG. 4 is a cross sectional view taken on line IV—IV of FIG. 3.

FIGS. 3 and 4 illustrate another preferred embodiment of a watch module construction according to the present invention; FIG. 3 is a plan view of the watch module construction and FIG. 4 is a cross section taken on line IV—IV of FIG. 3, with like parts bearing like reference numerals as those used in FIGS. 1 and 2. In this illustrated embodiment, the display cell 10 is retained in a fixed position by a pair of retaining plates 44 secured to the first support frame 12 by means of fastening means such as screws 46. Another feature is that the second support frame 32 is dispensed with and, instead thereof, the metal support plate 42 has a pair of radially extending flange portions 42*a* by which the ceramic substrate 30 is retained. The metal support plate 42 also has a plurality of vertical projections partially conforming to the shape of the battery 40 to retain the outer periphery thereof in fixed place. The metal support plate 42 of this configuration can be provided by press working on a mass production basis. One electrode of the battery 40 is connected to the metal support plate 42*a*, through which the battery is electrically connected to electrical contact terminal 48 formed on the underside of the ceramic substrate 30 vis the flange portions 42*a* to provide electrical connections between the battery 40 and the components on the substrate 30. The substrate 30 also serves as mounting platform for a quartz crystal oscillator 50 and other electronic components (not shown).

Figure 6:
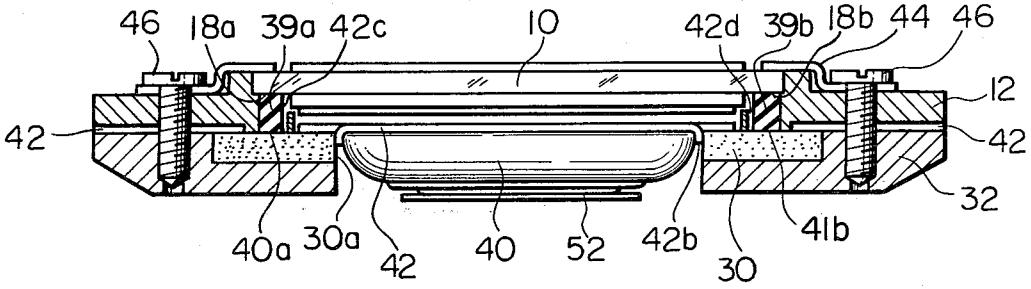
FIG. 6 is a cross section taken on line V—V of FIG. 5.
Figure 5:
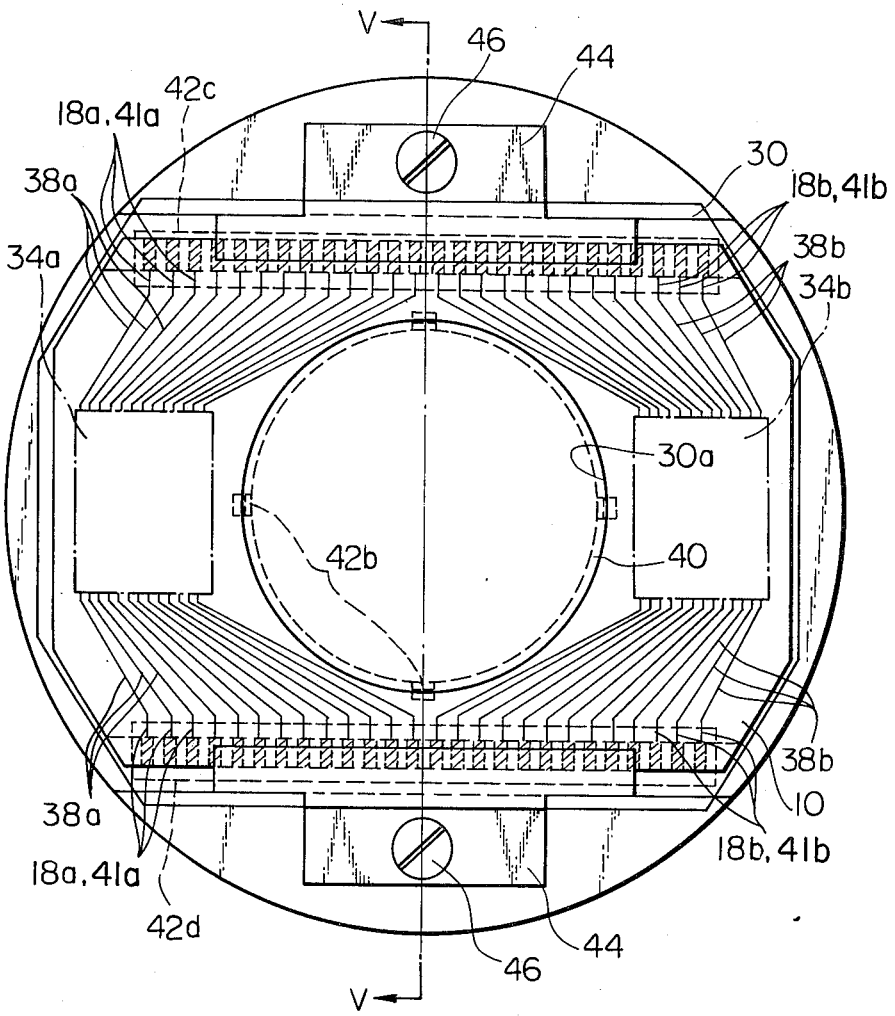
FIG. 5 is a plan view of still another preferred embodiment of the watch module construction according to the present invention.

FIGS. 5 and 6 shows a further preferred embodiment of the module assembly according to the present invention. In this illustrated embodiment, the integrated circuit chip 34 comprises first and second circuit chips 34*a* and 34*b* which are mounted on the ceramic substrate 30 at positions symmetric with respect to each another. Each of the circuit chips 34*a* and 34*b* is smaller in size than the single integrated circuit chip 34, and the freedom of arrangement of the individual circuit chips 34*a* or 34*b* can be increased. In a case where the electronic circuits are incorporated in a single integrated circuit chip, there is a limitation for the number of output leads which can be provided on the single integrated circuit chip and the productivity of the integrated circuit chip is lower than that of the integrated circuit chips separated from each other. Another drawback is encountered with the single integrated circuit chip in that the number of wire-bonding processes per one circuit chip for the single type integrated circuit chip is larger than that for the plural integrated circuit chips and the reliability in circuit connections will be lowered. Thus, by dividing the integrated circuit chip into plural chips, the above problem can be solved. This is particularly advantageous for a liquid crystal display type electronic timepiece in which the number of output leads from the integrated circuit chips is more than 40.

Turning now to FIGS. 5 and 6, upper side of the ceramic substrate 30 is formed with printed circuit leads 38*a* and 38*b* arranged substantially symmetric with respect to each other and connected to electrical contact terminals 40*a* and 40*b* formed on the upper side of the substrate 30, respectively. The electrical contact terminals 41*a* and 41*b* are precisely aligned with electrical contact terminals 18*a* and 18*b* on the display cell 10. The cutout 30*a* is formed in the substrate 30 at its central position to accommodate the battery 40 thereat. The battery 40 is positioned by a plurality of circumferentially spaced axial projections 42*b* extending from the battery support plate 42 and retained in fixed place thereby. The battery support plate 42 also has two rows of longitudinally extending elongated slots 42*c* and 42*d* parallel to each other along the rows of the electrical contact terminals to provide spacings for conductive rubber rods 39*a* and 39*b*. The conductive rubber rods 39*a* and 39*b* are disposed between the display cell 10 and the circuit substrate 30 to provide electrical connections therebetween. Indicated as 52 is a battery retaining plate, by which the battery 40 is urged against the battery support plate 42 and electrically connected to a terminal (not shown) secured to the second support frame 32.

With this arrangement, the battery 40 and the integrated circuit chips 34*a* are located in a straight line on the substantially same plane at the back side of the display cell 10 so that thickness of the module can be significantly reduced. Since the battery 40 is located at the center of the substrate 30 between the integrated circuit chips 34*a* and 34*b* and between the rows of the electrical contact terminals, the watch module may have a reduced thickness along its outer periphery as compared to the central part thereof. Therefore, the peripheral portion of a watch case into which the module of the present invention is incorporated can be reduced in thickness by providing a slanted surface. In addition, since a plurality of integrated circuit chips divided from each other are separately mounted on the substrate, assembling of the module construction can be easily performed and the reliability of circuit connections can be increased. The module of this preferred embodiment is especially advantageous for electronic timepieces having various functions such as calender function, stopwatch function or a world time calculating function etc. in which the integrated circuit chip should have a large number of output leads. In this case, the integrated circuit chips are divided into a plurality of circuit chips, which may be arranged in the same manner as previously described and the effective use of space can be achieved. Since, in this case, the battery and the integrated circuit chips are located in a space different from the display cell, the amount of space available for the digital display can be maximized.

It will now be appreciated from the foregoing description that in accordance with the present invention it is possible to provide a watch module assembly which is simple in construction, easy to assemble, small in thickness and low in manufacturing cost. Another advantage in that since a battery and an integrated circuit chip or circuit chips are arranged on the substantially same plane at the back side of a display cell, the amount of space available for digital display can be maximized and the thickness of the module assembly can be significantly reduced. Moreover, since the battery is retained by a battery support plate secured to a support frame, the module assembly has an increased rigidity and provides a shock-proof property.

While the present invention has been shown and described with reference to particular embodiments, it should be noted that various other changes or modification may be made without departing from the scope of the present invention.

What is claimed is:

1. A watch module construction comprising:

an electrooptical display cell having first separate rows of electric contact terminals, said first rows being spaced from and parallel to one another;

a first support frame including means for retaining said display cell in a fixed place;

a second support frame fixedly connected to said first support frame;

a printed circuit substrate disposed on said second support frame and having second rows of electric contact terminals formed on said substrate with printed circuit leads formed thereon, said printed circuit leads being connected to said second rows of electric contact terminals and terminating on said substrate at an area displaced from a center of said first support frame;

an integrated circuit chip mounted on said area of said substrate and connected to said printed circuit leads;

compressible conductive rubber members disposed between said first and second rows of electric terminals to provide electrical connections therebetween; and a battery support plate disposed between said first and second support frames and adapted to support a battery thereon;

said second support frame and said substrate having cutouts formed at a position opposing said area with respect to the center of said first support frame to accommodate said battery in line with said integrated circuit chip on a plane parallel to said display cell.

2. A watch module according to claim 1, in which said first and second support frames are made of plastic.

3. A watch module according to claim 1 in which said battery support plate is made of metal.

4. A watch module construction comprising:

an electrooptical display cell having first separate rows of electric contact terminals, said first rows being spaced from and parallel to one another;

a support frame including means for retaining said display cell in a fixed place;

a battery support plate secured to said support frame and adapted to support a battery thereon and having at least one radially extending flange portion;

a printed circuit substrate retained by the flange of said support frame and having second rows of electric contact terminals formed on said substrate with printed circuit leads formed thereon, said printed circuit leads being connected to said second rows of electric contact terminals and terminating on said substrate at an area displaced from a center of said first support frame, said substrate having a cutout at a position to accommodate said battery;

an integrated circuit chip mounted on said area of said substrate and connected to said printed circuit leads; and compressible conductive rubber members disposed between said first and second rows of electric terminals to provide electrical connections therebetween.

5. A watch module according to claim 4, in which said battery support plate also has axially extending projections engaging with an outer periphery of said battery.

6. A watch module construction comprising:

an electrooptical display cell having first separate rows of electric contact terminals, said first rows being spaced from and parallel to one another;

a first support frame including means for retaining said display cell in a fixed place;

a second support frame fixedly connected to said first support frame;

a printed circuit substrate disposed on said second support frame and having second rows of electric contact terminals formed on said substrate with printed circuit leads formed thereon, said printed circuit leads being connected to said second rows of electric contact terminals and terminating on said substrate at first and second areas displaced from a center of said substrate;

first and second integrated circuit chips mounted on said first and second areas of said substrate, respectively, and connected to said printed circuit leads;

compressible conductive rubber members disposed between said first and second rows of electric terminals to provide electrical connections therebetween; and a battery support plate disposed between said first and second support frames and adapted to support a battery thereon;

said second support frame and said substrate having cutouts formed at the same position as the center of said substrate to accommodate said battery.

7. A watch module according to claim 6, in which said battery support plate has a plurality of circumferentially spaced axial projections by which said battery is retained in said cutout of said substrate.

8. A watch module according to claim 6, in which said battery support plate has parallel extending elongated slots aligned with the first and second rows of said electrical contact terminals to provide spacings to accommodate said compressible conductive rubber members therein.

9. A watch module construction comprising:

an electrooptical display cell having first separate rows of electric contact terminals, said first rows being spaced from and parallel to one another;

a first support frame including means for retaining said display cell in a fixed place;

a second support frame fixedly connected to said first support frame;

a printed circuit substrate disposed on said second support frame and having second rows of electric contact terminals formed on said substrate with printed circuit leads formed thereon, said printed circuit leads being connected to said second rows of electric contact terminals and terminating on said substrate at an area displaced from a center of said first support frame;

an integrated circuit chip mounted on said area of said substrate and connected to said printed circuit leads;

compressible conductive rubber members disposed between said first and second rows of electric terminals to provide electrical connections therebetween; and a battery support plate disposed between said first and second support frames and adapted to support a battery thereon;

said second support frame and said substrate having cutouts formed at a position opposing said area with respect to the center of said first support frame to accommodate said battery in line with said integrated circuit chip on a plane parallel to said display cell.

* * * * *